US006367690B1

(12) United States Patent
McClure

(10) Patent No.: US 6,367,690 B1
(45) Date of Patent: Apr. 9, 2002

(54) CONTAINER WITH TABBED COVER

(75) Inventor: Jack A. McClure, Omaha, NE (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/879,072

(22) Filed: Jun. 11, 2001

Related U.S. Application Data

(60) Provisional application No. 60/210,387, filed on Jun. 9, 2000.

(51) Int. Cl.[7] ..... B65D 5/20; B65D 5/42

(52) U.S. Cl. ..... 229/143; 229/142; 229/154

(58) Field of Search ..... 229/142, 143, 229/149, 154, 920

(56) References Cited

U.S. PATENT DOCUMENTS 4,239,148 A * 12/1980 Sorenson et al. ..... 229/149
4,319,710 A * 3/1982 Osborne ..... 229/143
4,600,142 A * 7/1986 Quaintance ..... 229/143
4,842,189 A * 6/1989 Czosnyka ..... 229/143
5,000,377 A * 3/1991 McClure ..... 229/154
5,261,594 A 11/1993 Brown et al.
5,285,956 A 2/1994 Piepho
5,289,970 A * 3/1994 McClure ..... 229/143
5,289,971 A * 3/1994 McClure ..... 229/154
5,392,985 A * 2/1995 Smith et al. ..... 229/143
6,135,347 A * 10/2000 Mueller ..... 229/142

* cited by examiner

*Primary Examiner*—Gary E. Elkins
(74) *Attorney, Agent, or Firm*—Christensen O'Connor Johnson Kindness PLLC

(57) ABSTRACT

A cover panel improvement is described for a container having a bottom panel, side walls, end walls, and an open top. The improvement includes first and second cover panels connected to the side walls. Each cover panel includes side tabs that extend outwardly and fold down onto the end walls of the container. Portions of the cover panel overlap, as do portions of the side tabs. Various embodiments are provided regarding the size, shape, and placement of heavy and zero crush areas in the side tabs and cover panels. The heavy crush areas are used to reduce the overall thickness of the side tabs where overlapped. Openings may be used along the hinge line between the side tabs to help in properly forming the respective hinge line, e.g., by making the side tab more flexible along its fold line. Likewise, a spine may be used to help maintain tab stiffness.

34 Claims, 9 Drawing Sheets

CONTAINER WITH TABBED COVER

CROSS-REFERENCE TO RELATED APPLICATION

This application claims priority under 35 U.S.C. § 119(e) to Provisional Application No. 60/210,387, filed Jun. 9, 2000.

FIELD OF THE INVENTION

The present invention relates to corrugated paperboard containers that are used to ship heavy products during shipment, and more particularly, to an improvement to such containers to ensure scaling and integrity of the container against tampering or contamination.

BACKGROUND OF THE INVENTION

In the food packaging industry, products are often packaged in a container that must be sealed against tampering and made to maintain integrity during shipping, storage, and handling. This is typically done by forming a corrugated tray, loading the product into the tray, and then sealing the tray closed. The containers used for shipment of refrigerated fresh meats, in particular, generally include cover panels that fold inward from upright side panels of the tray. The cover panels include side tabs (also called "glue tabs") that are glued to the exterior surfaces of the tray's upright end panels. See, for example, the container of U.S. Pat. No. 5,261,594. As shown in the '594 patent and in the prior art container of FIG. 1, these tabs have historically been independently glued to the end panel.

A more recent innovation is the use of side tabs that overlap and are laminated to one another. (As used herein, the term "laminated" means adhered together.) These overlapping laminated tabs have presented some new and difficult challenges to fully sealing the top of a box. During assembly, a tray former creates the basic box shape of a bottom panel with upright side walls. Next, vacuum-packed meat product is placed in the tray and the combination is moved to a sealing area. Glue is applied to the side tabs and to the overlapping area of the cover panels, which are folded from their respective side walls. The container is then placed in a compression area. In the compression area, the tabs are held against the side panels for a period of time.

There are a number of problems associated with the sealing process for these types of containers. It can occur that the tabs are inappropriately folded back and glued against the upper surface of the cover during the sealing process. This is due in part to the configuration of known sealing conveyor systems, where a steel plow bar guides the tabs of the forward end of the container. When this occurs, the tabs are then not available to be properly glued to the end panels of the container. The tabs generally stick out and can become mangled against machine components and other adjacent containers.

A further problem is that, occasionally, the tabs come loose from the end panels after the container has left the final compression area. Both of these problems leave the cover unsecured, which is undesirable for stopping tampering and/or contamination. In addition, an unsecured cover can cause stacked containers to "telescope" into one another, i.e., upper containers crushing down into lower containers when placed in a vertical stack. The present invention addresses these and other problems as well.

SUMMARY OF THE INVENTION

In accordance with the teachings of the present invention, a cover panel improvement is described for a container having a bottom panel, side walls, end walls, and an open top. The improvement includes first and second cover panels connected to the side walls. Each cover panel includes side tabs that extend outwardly and fold down onto the end walls of the container. Portions of the cover panel overlap, as do portions of the side tabs. Various embodiments are provided regarding the size, shape, and placement of heavy and zero crush areas in the side tabs and cover panels. The heavy crush areas are used to reduce the overall thickness of the side tabs where overlapped. Openings may be used along the hinge line between the side tabs to help in properly forming the respective hinge line. Likewise, a spine may be used to help maintain tab stiffness.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
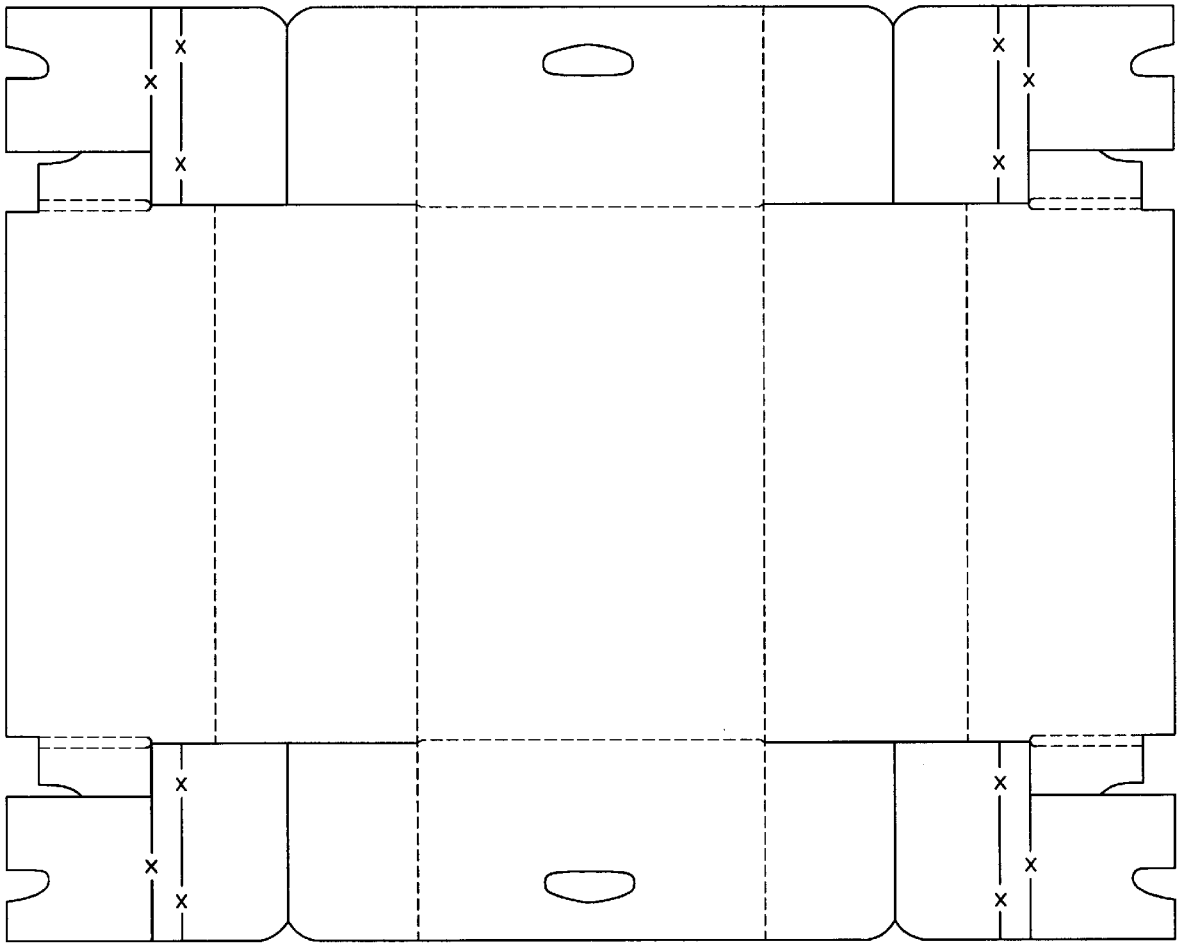
Fig. 1. (PRIOR ART)
FIG. 1 is a plan view of a prior art container blank.
Figure 2:
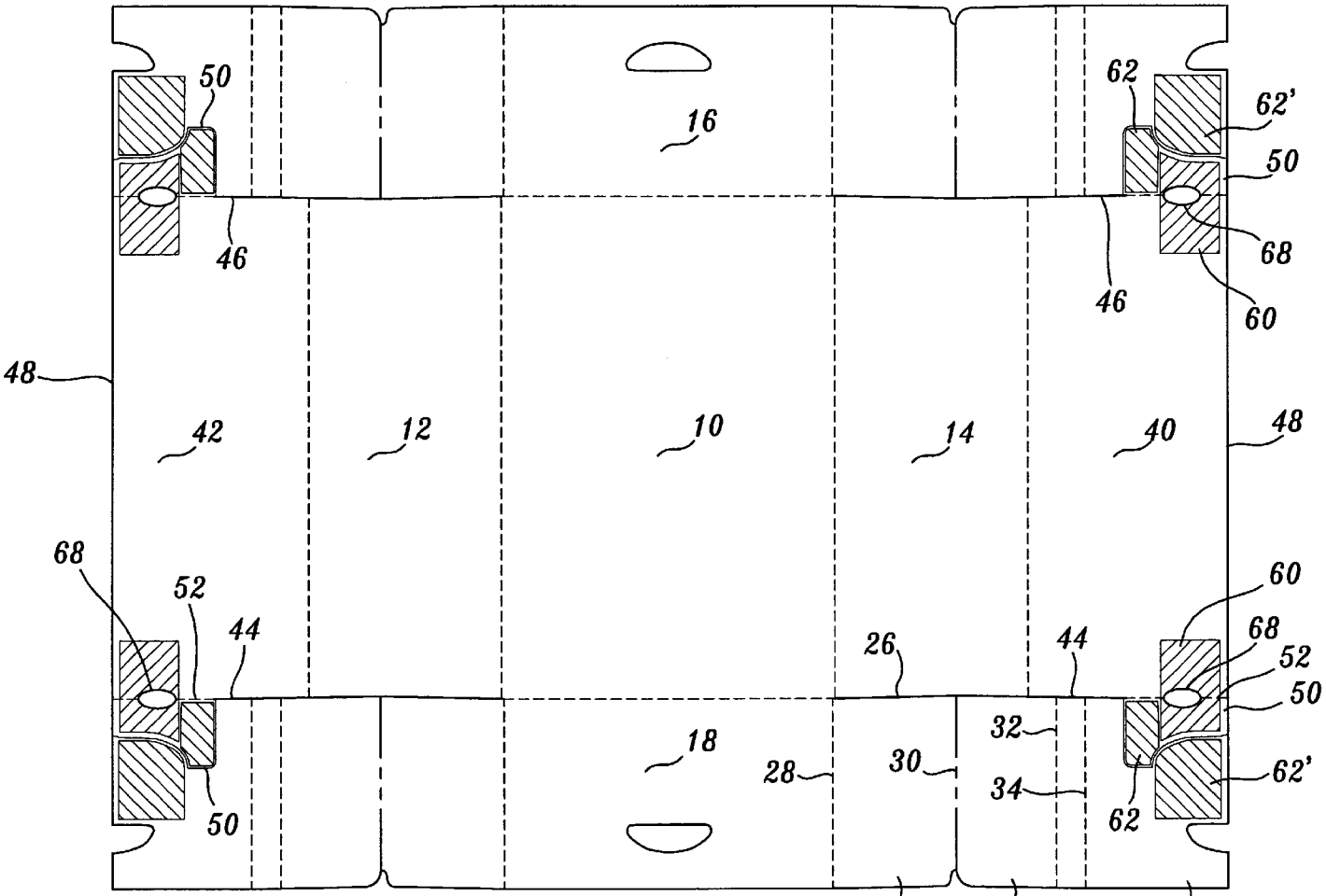
FIG. 2 is a plan view of a first embodiment of a container blank formed in accordance with the present invention.

The present invention is a container having a uniquely configured tabbed cover. Referring to FIG. 2, the container blank includes a rectangular bottom panel 10, opposed first and second side panels 12, 14, and opposed end panels 16, 18. The side panels 12, 14 are hingedly connected to opposed side edges of the bottom panel 10, and the end panels 16, 18 are hingedly connected to opposed end edges of the bottom panel 10. In general, the height of an assembled container is less than its width or depth, so that the container appears as a tray.

In the embodiment of FIG. 2, a series of three end sections 20, 22, 24 are foldably connected to each side edge of each end panel. The end panels 20, 22, 24 are severed from the side and cover panels along a first cut line 26. The first end section 20 is hinged to an end panel along a first fold line 28. The second end section 22 is hinged to the first end section 20 along a second fold line 30. The third end section 24 is hinged to the second end section 22 along a third fold line 32. An optional fourth fold line 34 is available, and works in conjunction with the third fold line 32 to form a corner post as assembled. To assemble the side and end walls, the third and second end sections 24, 22 are folded along the second fold line 30 and onto the first end section 20 and end panel, respectively. The combination of the first and second end sections 20, 22 is then folded upright relative to the end panel and third section. All end pieces are then folded inward so that the first and second end sections 20, 22 are adjacent and inward of their corresponding side wall.

As will be appreciated, this arrangement of end sections is optional to the present invention. It does, however, provide additional strength to the container and may be used when needed. As used herein the term "end wall" refers generically to the combination of panels that form the upright ends of the container. Likewise, the term "side wall" refers generically to the combination of panels that form the upright sides of the container. As will be appreciated, the present invention may be accomplished on a wide range of container types.

Still referring to FIG. 2, first and second cover panels 40, 42 are hingedly connected to the upper edge of the first and second side panels 12, 14, respectively. Each cover panel includes side edges 44, 46 and an outermost exterior longitudinal edge 48. As assembled, the cover panels overlap along their outermost exterior longitudinal edge 48. In doing so, one of the cover panels is referred to as an underside cover panel and the other is referred to as an overside cover panel. In FIG. 2, the first cover panel 40 is the underside cover panel, and the second cover panel 42 is the overside cover panel.

Still referring to FIG. 2, each cover panel includes a side tab 50 hingedly connected to the cover panel along its side edges and extending outwardly therefrom. The side tab is hinged along a fifth fold line 52. In FIG. 2, the fifth fold line 52 is aligned with the first cut line 26. In this embodiment, the first cut line 26 is formed at the same location as the cover panel side edges 44, 46, except at the location of the side tabs 50. At the side tabs 50, the first cut line 26 follows the outer tab shape and the fifth fold line 52 continues outward from the first cut line 26. In the embodiment of FIG. 2, the side tab 50 is thus taken from material provided by the third end section 24. Each side tab 50 extends from the outermost exterior longitudinal edge 48 of a cover panel to approximately half the distance of the cover panel side edge 44.

To assemble, the container side and end walls are formed upright to the bottom panel 10. Adhesive is placed on the interior surface of the longitudinal edge 48 of the overside cover panel 42 or on the exterior surface of the longitudinal edge 48 of the underside cover panel 40, and on the interior surface of all side tabs 50. The underside cover panel 40 is then folded over laterally onto the side and end walls. The overside cover panel 42 is folded inward, on top of the underside cover panel 40. The longitudinal edge 48 of the overside cover panel 42 is adhered to the exterior surface of the longitudinal edge 48 of the underside cover panel 40. Likewise, the side tabs of the overside cover panel 42 are adhered to the exterior surface of the side tabs of the underside cover panel 40. The combination of side tabs 50 from the overside and underside cover panels 42, 40 is then folded downward and adhered to the exterior surfaces of the end panels 16, 18. In this manner, the container is well closed and sealed.

In accordance with teachings of the present invention, the overlapping side tabs 50 may be formed in various ways. In the embodiment of FIG. 2, each side tab includes a heavy crush area 60 and a zero crush area 62. The heavy crush area 60 corresponds with the overlap zone between the side tabs 50, as assembled. As shown, the heavy crush area 60 may be extended into portions of the cover panel as well, to aid in the compression step. The third end section 24 also preferably includes a zero crush area 62' located in an area just below the overlapping side tabs 50, as assembled. This lower zero crush area 62' is useful for assuring correct folding of panel 24 during the tray forming operation. This crush area may be created during die cutting, or during subsequent forming or sealing operations.

An opening 68 is formed along the fifth fold line 52 in the region of the side tab heavy crush area 60. The opening has an oval shape and is provided to reduce the size of the fold line in the heavy crush area. This helps to reduce the chance that the fifth fold line 52 will be malformed. By eliminating portions of the fifth fold line 52 in the heavy crush area 62, it is also more likely that the tab 50 will maintain a rigid form. The fifth fold line 52 in this embodiment is preferably formed using a 4-point score.

Figure 3:
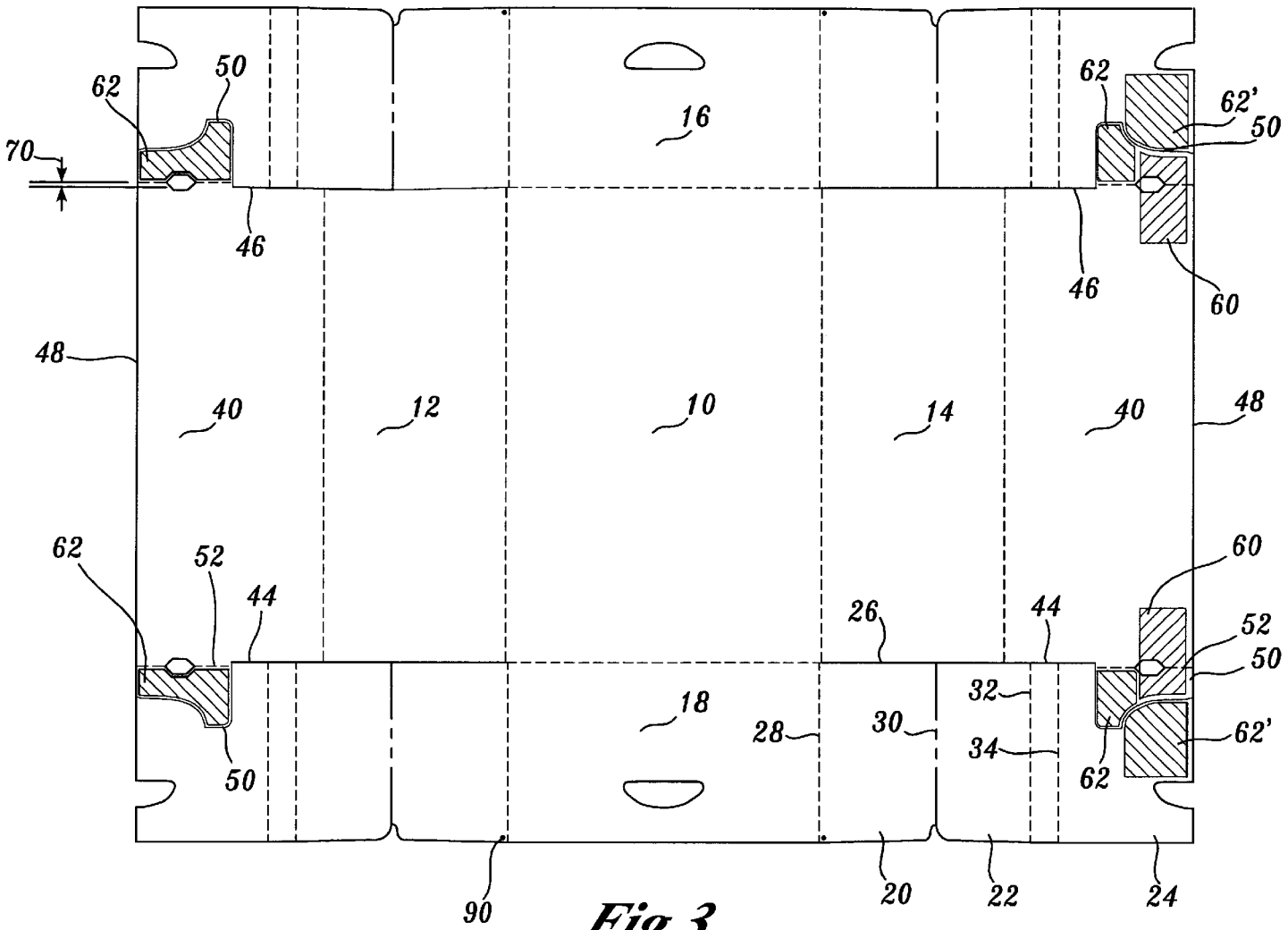
FIG. 3 is a plan view of a second embodiment of a container blank formed in accordance with the present invention.

A second embodiment is shown FIG. 3. The side tabs 50 along the underside cover panel 42 are similar to the embodiment of FIG. 2, with the addition of a lateral offset (labeled item 70) added to the location of the fifth fold line 52 relative to the cover panel side edges 44, 46. As shown, the fifth fold line 52 is moved outward a small amount, e.g., in the range of about 1/8-inch to about 3/8-inch, a preferred amount being about 3/16-inch. The offset 70 is provided to reduce end panel pressure on the side tabs, which likewise decreases the tendency of the side tabs to pop open after leaving the compression section of the sealer. The fifth fold line 52 in the embodiment of FIG. 3 is formed with a heavy, well defined 4-point score within the heavy crush area 60, and an ultralight 4-point score for the remaining fifth fold line portions. The zero crush areas 62 and 62' are preferably made literally with zero crush. The opening 68 has a six-sided shape that is oriented symmetrically about the fifth fold line 52. Corners of the opening align with the fifth fold line 52, which tends to ensure that the fifth fold line 52 will be made properly.

Still referring to FIG. 3, the overside cover panel 42 does not include a heavy crush area 60, but instead is purposefully formed with a zero crush area 62 covering the entire tab 50. The fifth fold line 52 is formed using an ultralight 4-point score, and the opening is a symmetrical six-sided shape.

Figure 4:
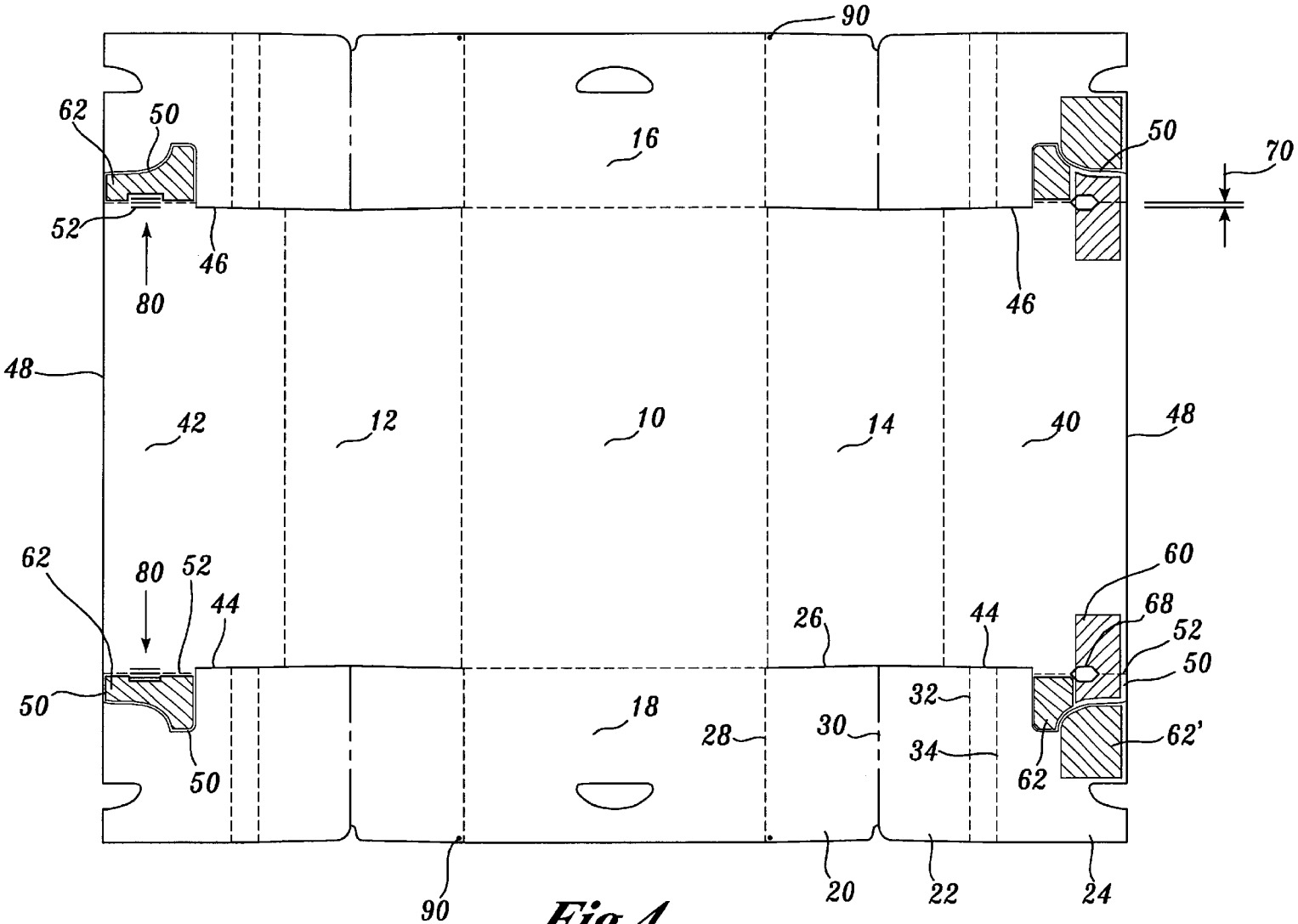
FIG. 4 is a plan view of a third embodiment of a container blank formed in accordance with the present invention.

The embodiment of FIG. 4 is similar to that of FIG. 3 except the openings 68 of the overside cover panel 42 are formed as a series of cuts 80. The cuts 80 are parallel to one another and are parallel, though not collinear, with the fifth fold line 52. The use of the parallel cuts instead of an opening along the overside tabs discourages adhesive from passing through and inadvertently being spread on the guide rails of the sealing machine during formation of the container. This reduces the possibility of the tabs catching against sticky glue on the guide rails, and thus being inappropriately glued back onto the upper surface of the cover panel.

Figure 5:
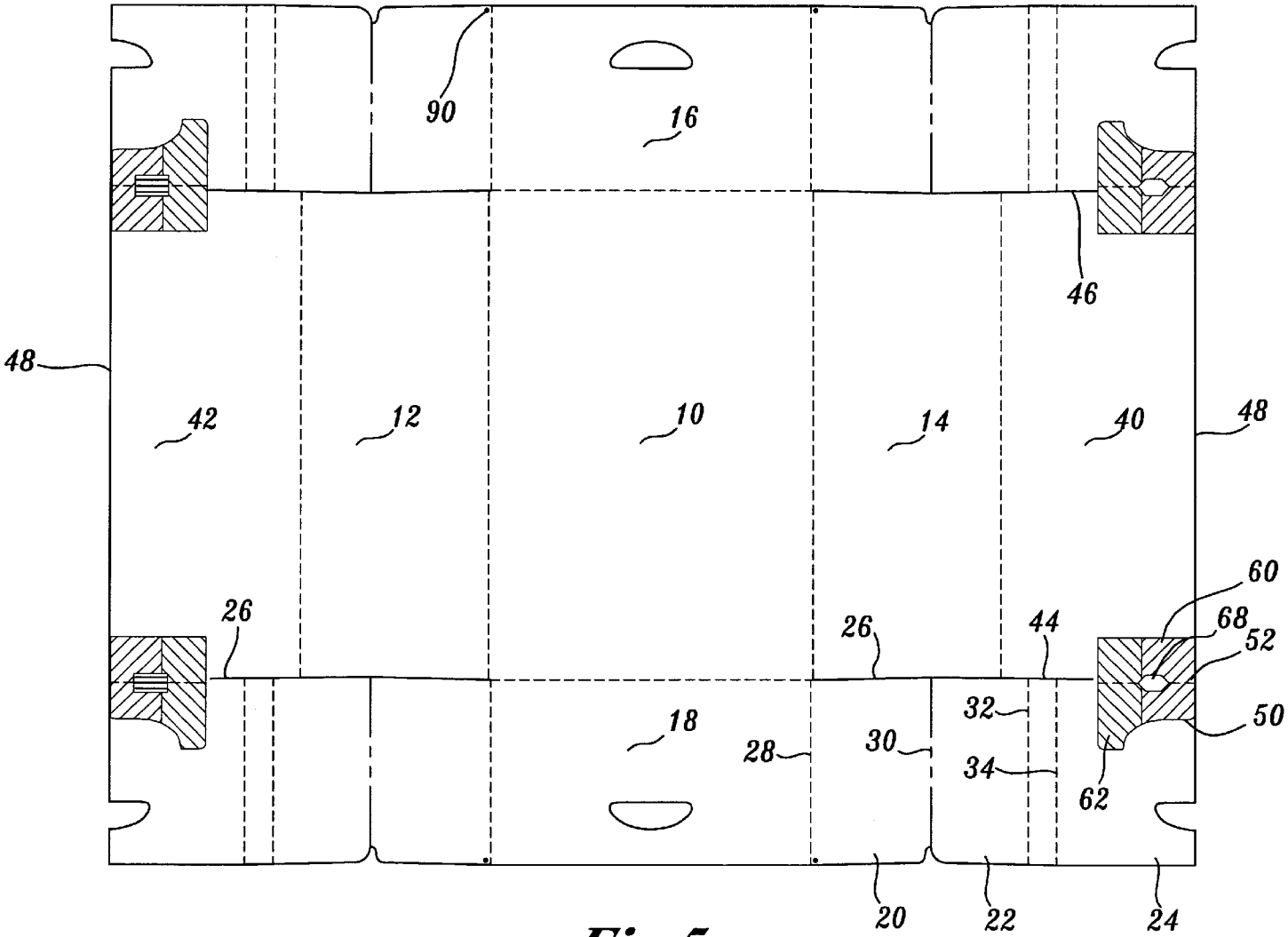
FIG. 5 is a plan view of a fourth embodiment of a container blank formed in accordance with the present invention.

The embodiment of FIG. 5 includes heavy crush areas 60 and zero crush areas 62 on both the underside and overside cover panel side tabs. Both the heavy and zero crush areas extend from the tabs into portions of their respective cover panels. The side tabs of the underside cover panel include an opening having a six-sided shape along its fifth fold line 52 in the heavy crush area. The fifth fold lines 52 in the underside cover panel 40 are outwardly offset 70 from the cover panel side edges 44, 46. The portion of the fifth fold line 52 located in the heavy crush area 60 is preferably formed using a heavy, well defined 8-point score.

Figure 7:
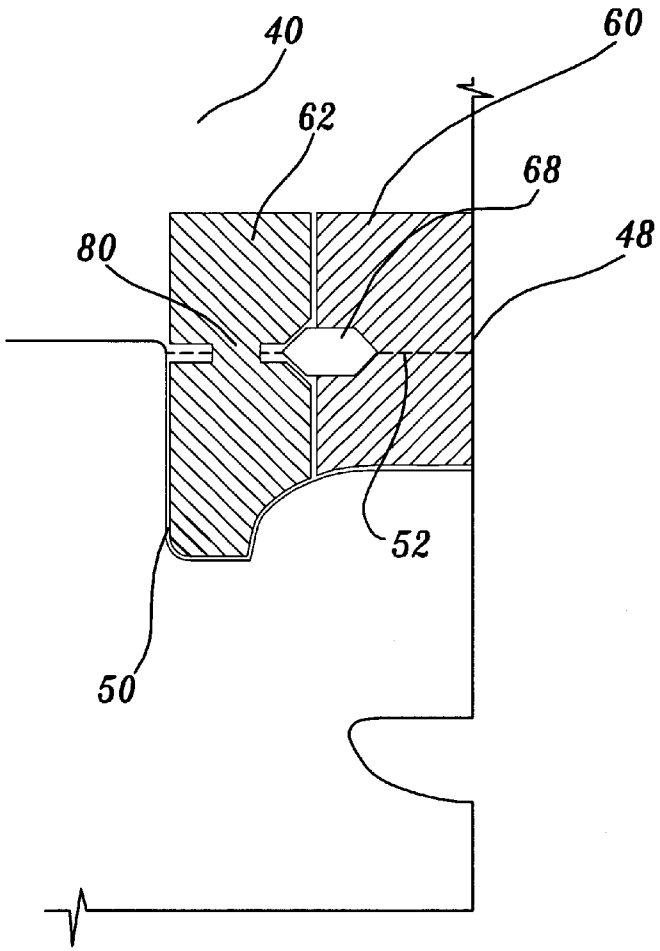
FIG. 7 is a close-up plan view of the side tabs on the underside cover panels of FIG. 5.
Figure 6:
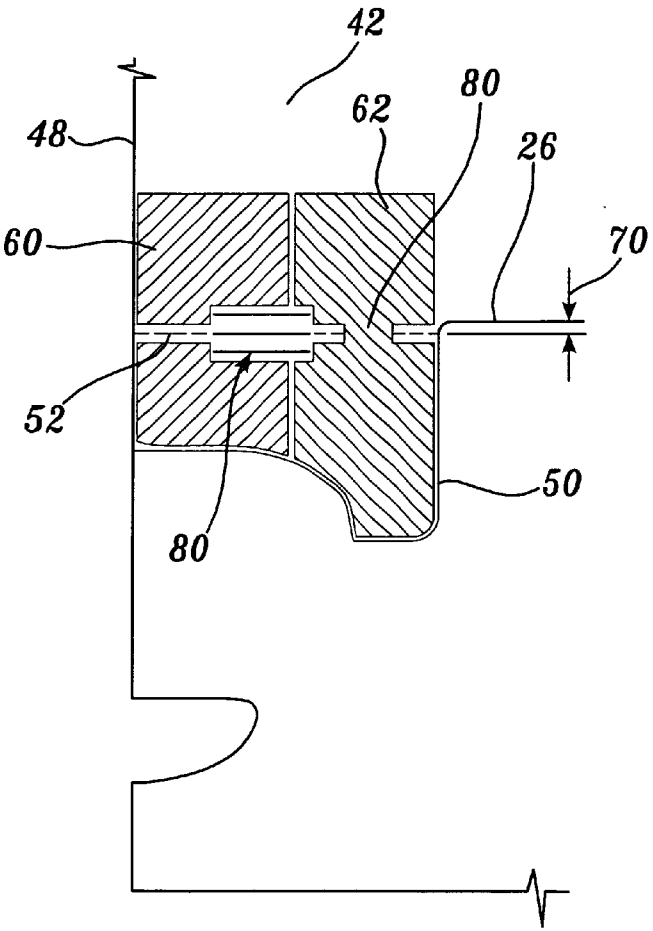
FIG. 6 is a close-up plan view of the side tabs on the overside cover panels of FIG. 5.

Referring to FIG. 7, the portion of the fifth fold line 52 located in the zero crush region is preferably formed using an ultralight 8-point score that is centrally gapped by a small amount, e.g., in the range of about ½-inch to about 1inch, a preferred amount being ¾-inch. The small gap in scoring forms a spine 80 30 between the tab 50 and the underside cover panel 40. The spine 80 provides a measure of resistance to the tab 50 so that the tab will not flop about undesirably during the folding and sealing steps. Referring to FIG. 6, the overside cover panel 42 is similarly formed, though with an opening formed as three parallel cuts 80 in lieu of a six-sided space.

Figure 8:
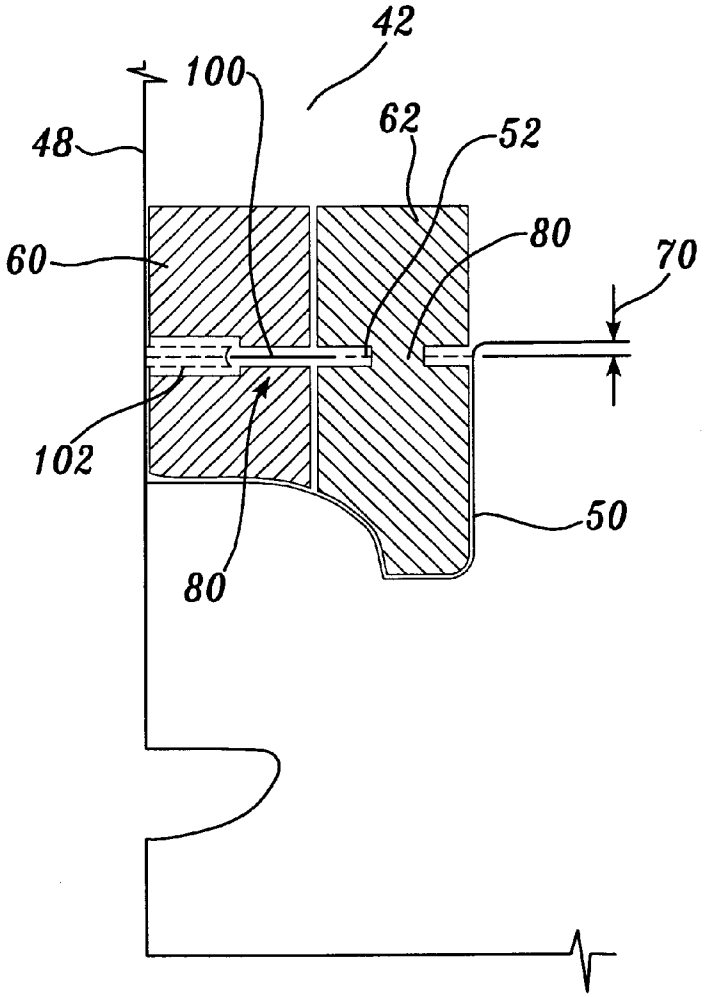
FIG. 8 is a close-up plan view of a fifth embodiment of a container formed in accordance with the present invention.

FIG. 8 is a further embodiment of the present invention in which the opening is formed as a cut 100 having a portion collinear with the fold line 52 and a portion with a transverse arcuate shape. The arcuate cut portion is located nearer to the cover panel longitudinal edge than to the collinear portion. Between the arcuate cut portion and the longitudinal edge, a series of parallel scores 102 are formed, preferably linearly centered on the cut line 100. The fold line 52 is offset by an amount 70, e.g., about ¼-inch, from the cover panel side edge (44 or 46). The parallel scores 102 are preferably made with heavy well defined 4-point scores, ⅛-inch apart. The heavy crush area includes a portion that extends into the cover panel itself. In one embodiment, all four side tabs are formed in this manner and are made to overlap completely in the heavy crush areas between respective first and second cover panels sides. A zero crush area 62 is provided having a spine 80. The fold line 52 is formed using an ultralight (e.g., –0.050) 8-point score, gapped ⅞-inch for the spine 80.

Figure 10:
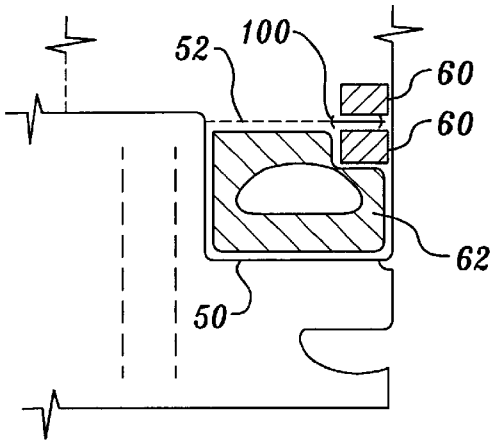
FIGS. 10 and 11 are close-up plan views of the first and second cover panel side tabs, respectively.
Figure 11:
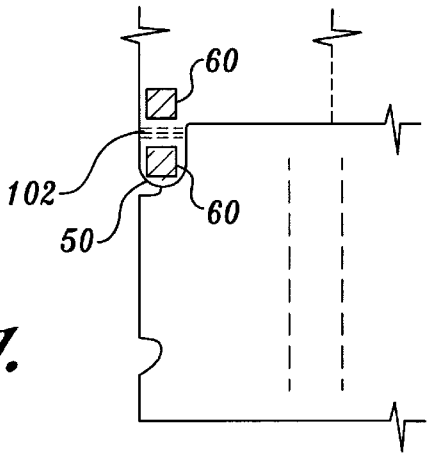
Figure 9:
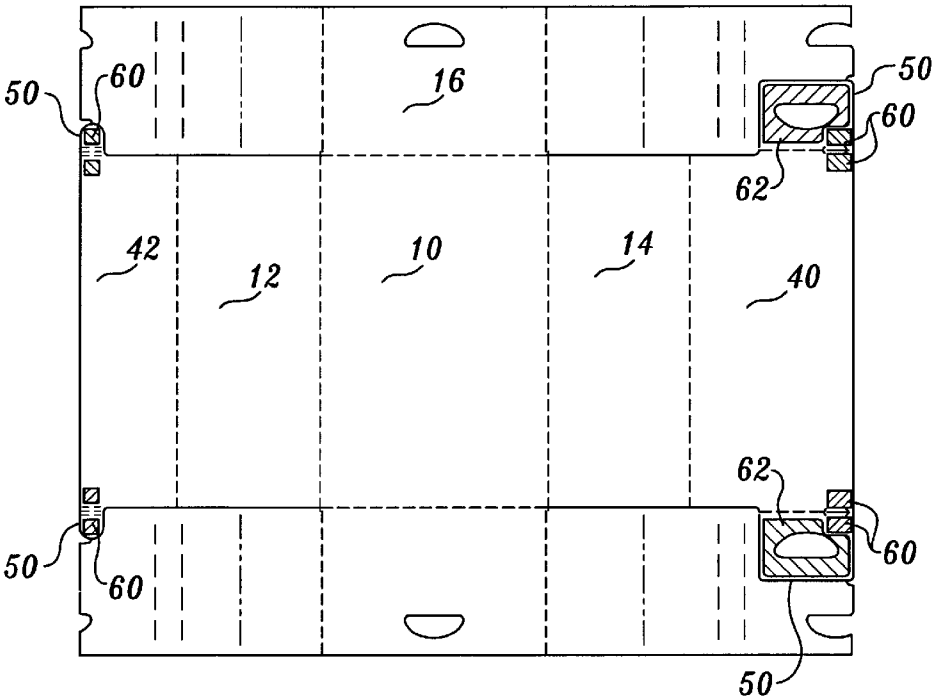
FIG. 9 is a plan view of another embodiment of a container blank formed in accordance with the present invention.

FIGS. 9, 10, and 11 illustrate yet another embodiment of the present invention in which the side tabs and crush areas of the first and second cover panels are formed in different sizes and shapes.

The term "heavy" as used in describing fold lines means a deeper than normal crush zone. The term "light" as used in describing fold lines means shallower than normal crush zone. As will be appreciated by those skilled in the art, a normal crush zone is relative to the type and thickness of material being used. The present invention is preferably formed using a single fluted material. A 4-point score line means a crush zone 0.056 inches wide (1⁄16" nominal). An 8-point score line means a crush zone 0.112 inches wide (⅛" nominal). The term "heavy" as used in describing crush areas means the flutes have been totally or near totally crushed. The term "zero crush area" means avoiding as much fluting crush as possible in an area. This may differ from doing nothing at all, in that squares of ejection rubber may be used on the die to get the box blank off the die, thus preserving as much fluting as possible. The term "zero crush area", however, should be understood to include instances where this is not possible, but where crush is at least not added purposefully.

The present invention reduces the likelihood of tabs coming loose and stacked containers telescoping, by use of a score definition at the desired fold line through the crushed portions. This enables the laminated tabs to fold purposefully, and not randomly, along a desired line in the crushed areas. This is accomplished by using a deep score with a thin noncrushed strip to each side of the fold score. This latter feature may be attained by skiving back on the rubber adjacent the score that is used to form the crushed areas, or by other means, such as reshaping the rubber.

Figure 12:
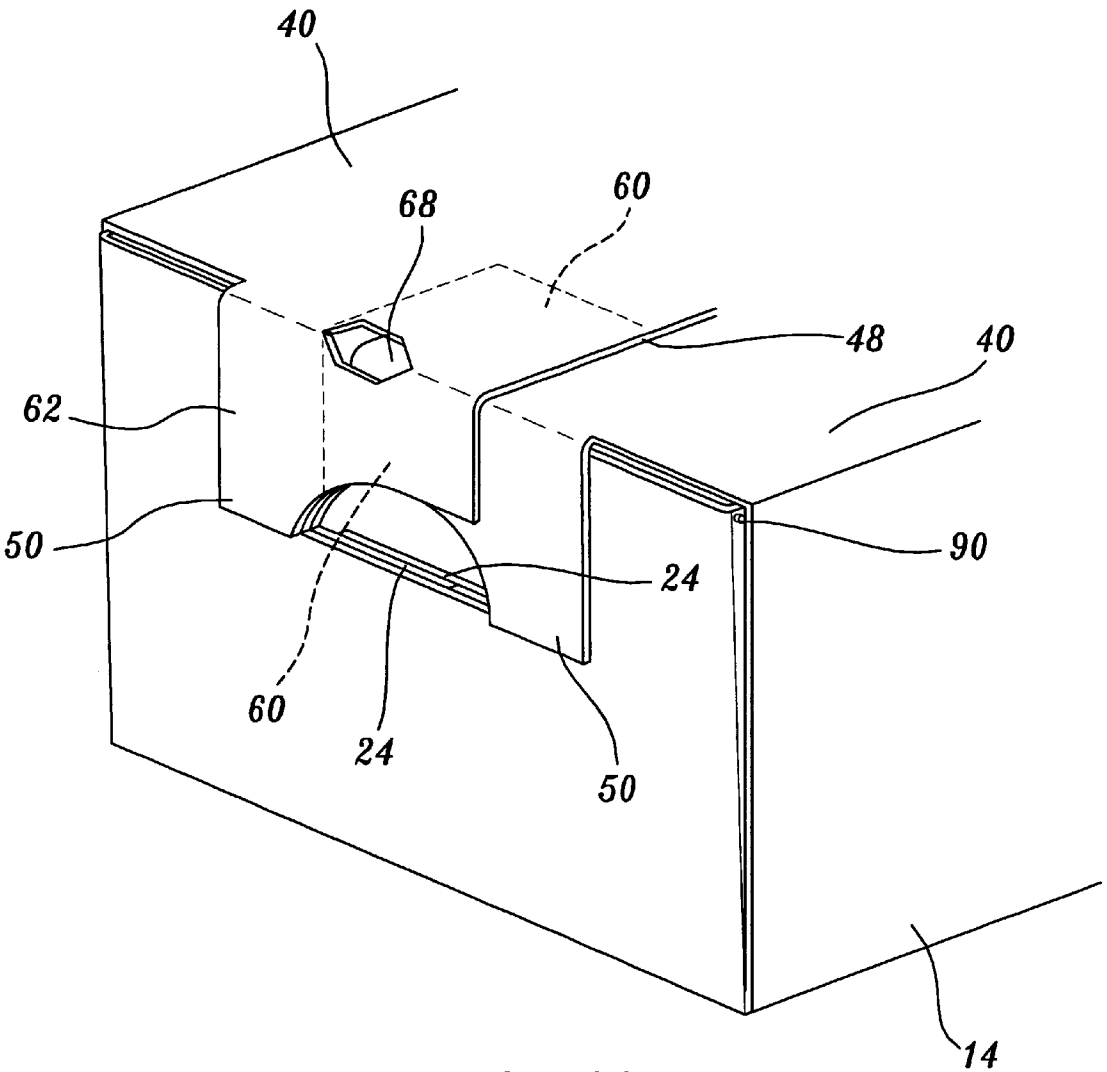
FIG. 12 is a perspective view of the embodiment of FIG. 3, further showing a registration pinhole formed in accordance with the present invention.

An important aspect of breaker boxes is having sufficient endurance capability in the final container. One feature that contributes to greater endurance is the formation of the box where the panels have not been crushed by the tray former. Another aspect in box strength is the proper forming of end panels and the use of corner posts. Current industry practices tend to set the end panel forming shoes too tight. This causes crushing of the panels and posts. Referring to FIG. 12, a registration pinhole 90 is preferably provided at each upper corner. The registration pinhole (or other convenient marking) may be placed in the container at a point of minimum end panel protrusion from the side panel. During formation, the operator may then check the placement of the pinhole to ensure correct formation of the box. Using this system, the resulting box is a more consistent, longer lasting box. This system may be used with other types of containers as well.

While the preferred embodiment of the invention has been illustrated and described, it will be appreciated that various changes can be made therein without departing from the spirit and scope of the invention. For example, the side tabs may be made in a wide variety of shapes and sizes depending on the application for which they will be needed. In addition, the side tabs between cover panels may vary or may be formed alike. By mixing and matching different tab configurations, the container can be optimized for its use. Further, the embodiments described herein include handle holes in their end panels. These holes are optional and may be omitted.

The embodiments of the invention in which an exclusive property or privilege is claimed are defined as follows:

1. In a tray container having a bottom panel, opposed side walls, opposed end walls, and an open top, an improvement comprising:

(a) a first cover panel hingedly connected to one of the side walls; the first cover panel including an outermost exterior longitudinal edge, opposed side edges, and a pair of tabs hinged from each side edge along a first hinge line;

(b) a second cover panel hingedly connected to the other of the side walls; the second cover panel including an outermost exterior longitudinal edge, opposed side edges, and a pair of tabs hinged from each side edge along a second hinge line; and (c) a heavy crush area formed in each side tab of the first cover panel, the heavy crush area extending into a portion of the first cover panel;

wherein, as assembled, the first and second cover panels extend laterally across the open top of the container with the cover panel longitudinal edges overlapping one another; and wherein, as assembled, the side tabs of the first cover panel are adhered to the exterior surface of the container end walls; the side tabs of the second cover panel are adhered to the exterior surfaces of the first cover panel side tabs and end wall, the side tabs of the first and second cover panels overlap one another so that portions of the heavy crush area of the first cover panel side tabs are located between the side tabs of the second cover panel and the end walls.

2. The improvement according to claim 1, wherein the side tabs of the first and second hinge lines each include an opening therealong.

3. The improvement according to claim 2, wherein each opening is shaped as an oval and is positioned symmetrically along the respective hinge line.

4. The improvement according to claim 2, wherein the opening has a six-sided shape and is positioned symmetrically along the respective hinge line so that opposite corners of the opening are aligned with the hinge lines.

5. The improvement according to claim 2, wherein the opening is formed from a number of cuts positioned parallel to one another and parallel to their respective hinge line.

6. The improvement according to claim 1, wherein the first and second hinge lines are parallel, though outwardly offset, from their respective cover panel side edges.

7. The improvement according to claim 1, further comprising a zero crush area formed in each side tab of the first cover panel at a location adjacent the heavy crush area.

8. The improvement according to claim 1, wherein the side tabs of the second cover panel include a heavy crush area that extends into the second cover panel along a portion located adjacent the longitudinal edge of the second cover panel, portions of the heavy crush areas of the first and second cover panel side tabs overlapping one another as assembled.

9. The improvement according to claim 8, wherein as assembled all portions of the heavy crush areas of the first and second cover panel side tabs overlap one another.

10. The improvement according to claim 1, further comprising a registration pinhole formed in each end wall to aid in outwardly aligning the side walls during assembly.

11. The improvement according to claim 1, further comprising a zero crush area formed in the side tabs of the second cover panel.

12. The improvement according to claim 11, wherein as assembled portions of the zero crush areas of the second cover panel side tabs overlap portions of the heavy crush areas of the first cover panel.

13. The improvement according to claim 12, wherein the hinge lines of both the first and second cover panels are parallel, though outwardly offset, from their respective cover panel side edges.

14. The improvement according to claim 12, wherein each side tab includes an opening therealong.

15. The improvement according to claim 14, wherein each opening has a six-sided shape and is positioned symmetrically along its respective hinge line so that opposite corners of the opening are aligned with the hinge lines.

16. The improvement according to claim 14, wherein the opening is formed from a number of cuts positioned parallel to one another and parallel to their respective hinge lines.

17. The improvement according to claim 1, wherein the first and second cover panels and their respective side tabs are configured alike.

18. The improvement according to claim 1, further comprising a zero crush area formed in each side tab of the first cover panel at a location adjacent the heavy crush area and extending into portions of the first cover panel.

19. The improvement according to claim 18, wherein each zero crush area includes a spine connecting those portions of the zero crush area that are located in the tab and those portions located in the first cover panel.

20. The improvement according to claim 19, wherein each side tab includes an opening therealong.

21. The improvement according to claim 20, wherein each opening has a six-sided shape and is positioned symmetrically along its respective hinge line so that opposite corners of the opening are aligned with the hinge lines.

22. The improvement according to claim 18, wherein the side tabs of the second cover panel include a heavy crush area that extends into the second cover panel along a portion located adjacent the longitudinal edge of the second cover panel, portions of the heavy crush areas of the first and second cover panel side tabs overlapping one another as assembled.

23. The improvement according to claim 22, further comprising a zero crush area formed in each side tab of the second cover panel at a location adjacent the heavy crush area and extending into portions of the first cover panel.

24. The improvement according to claim 23, wherein each zero crush area includes a spine connecting those portions of the zero crush area that are located in the tab and those portions located in the second cover panel.

25. The improvement according to claim 22, wherein each side tab of the second cover panel includes an opening along its respective hinge line.

26. The improvement according to claim 25, wherein each opening is formed from a number of cuts positioned parallel to one another and parallel to their respective hinge line.

27. The improvement according to claim 1, wherein the side tabs of the first cover panel extend from the first cover panel longitudinal edge to approximately half the distance along the first cover panel side edge.

28. The improvement according to claim 1, wherein the heavy crush area of the first cover panel covers the entire side tab area.

29. The improvement according to claim 1, wherein the side tabs of the first cover panel and the side tabs of the second cover panel are shaped and sized similarly.

30. The improvement according to claim 1, wherein the side tabs of at least one of the first and second hinge lines include an opening therealong.

31. The improvement according to claim 30, wherein the opening includes a cut and a series of parallel score lines, the parallel score lines being centered collaterally on the cut, and the combination of parallel score lines and cut being collinear with the at least one of the first and second hinge lines.

32. The improvement according to claim 30, wherein the opening cut includes a transverse arcuate cut shape at the parallel score lines.

33. The improvement according to claim 30, wherein parallel score lines are formed as heavy well defined 4-point scores spaced ⅛-inch apart.

34. The improvement according to claim 1, wherein the side tabs of the first cover panel and the side tabs of the second cover panel are of different shapes and sizes.

* * * * *